US007648557B2

(12) United States Patent
Irizarry-Rivera et al.

(10) Patent No.: US 7,648,557 B2
(45) Date of Patent: Jan. 19, 2010

(54) PROCESS FOR MAKING HIGHLY DISPERSIBLE SPHERICAL SILVER POWDER PARTICLES AND SILVER PARTICLES FORMED THEREFROM

(75) Inventors: Roberto Irizarry-Rivera, Manati, PR (US); Howard David Glicksman, Durham, NC (US); Victor M. Rivera Alvarado, Manati, PR (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 150 days.

(21) Appl. No.: 11/809,486

(22) Filed: May 31, 2007

(65) Prior Publication Data

US 2008/0028889 A1 Feb. 7, 2008

Related U.S. Application Data

(60) Provisional application No. 60/810,359, filed on Jun. 2, 2006.

(51) Int. Cl.
*C22B 3/44* (2006.01)
*C22B 11/00* (2006.01)

(52) U.S. Cl. ..... 75/371; 75/733

(58) Field of Classification Search ..... 75/331, 75/733

See application file for complete search history.

(56) References Cited

U.S. PATENT DOCUMENTS 5,188,660 A * 2/1993 Tosun et al. ..... 75/370

FOREIGN PATENT DOCUMENTS

| | | | |
|---|---|---|---|
| DE | 259000 A1 | | 8/1988 |
| HU | 194758 | | 8/1988 |
| JP | 63-307206 | | 12/1988 |
| JP | 63307206 A | * | 12/1988 |
| WO | WO 2005/075133 A1 | | 8/2005 |

OTHER PUBLICATIONS

Macek et al., "Preparation of Sub- and Micrometer Silver Powders", Materiali in Tehnologije, vol. 39, No. 4, 2005, pp. 113-118 (English Abstract).

Nagaoka et al., "Investigation and Application of Silver Powder Reduced with L-Ascorbic Acid (or LAX Ag)", International Precious Metals Conference, Jun. 14, 2003, pp. 9-21.

Sondi et al., "Preparation of Highly Concentrated Stable Dispersions of Uniform Silver Nanoparticles", J. Colloid and Interface Science, vol. 260, No. 1, 2003, pp. 75-81.

Widoniak et al., "Silver Particles Tailoring of Shapes and Sizes", Colloids and Surfaces A: Physicachemical and Engineering Aspects, Elsevier, Amsterdam, NL, vol. 270-271, 2005, pp. 340-344.

Suber et al., "Preparation and the Mechanisms of Formation of Silver Particles of Different Morphologies in Homogeneous Solutions", J. of Colloid and Interface Science, Academic Press, NY, vol. 288, No. 2, 2005, pp. 489-495.

PCT International Search Report and Written Opinion of International Application No. PCT/US2007/012993 dated Nov. 14, 2007.

* cited by examiner

*Primary Examiner*—George Wyszomierski
*Assistant Examiner*—Tima M McGuthry-Banks

(57) ABSTRACT

Disclosed is an improved process for making highly dispersible, spherical silver particles. In particular, the invention is directed to a process for making silver particles, which are very high solids and highly ordered. The silver particles formed are particularly useful in electronic applications.

12 Claims, No Drawings

PROCESS FOR MAKING HIGHLY DISPERSIBLE SPHERICAL SILVER POWDER PARTICLES AND SILVER PARTICLES FORMED THEREFROM

This application claims priority to U.S. 60/810,359, filed Jun. 2, 2006.

FIELD OF THE INVENTION

The invention is directed to an improved process for making highly dispersible, spherical silver particles. In particular, the invention is directed to a process for making silver particles, which are very high solids and highly ordered. The silver particles formed are particularly useful in electronic applications.

TECHNICAL BACKGROUND OF THE INVENTION

Silver powder is used in the electronics industry for the manufacture of conductor thick film pastes. The thick film pastes are screen printed onto substrates forming conductive circuit patterns. These circuits are then dried and fired to volatilize the liquid organic vehicle and sinter the silver particles.

Printed circuit technology is requiring denser and more precise electronic circuits. To meet these requirements, the conductive lines have become narrower in width with smaller distances between lines. The silver powders necessary to form dense, closely packed, narrow lines must be as close as possible to monosized, dense packing spheres.

Many methods currently used to manufacture metal powders can be applied to the production of silver powders. For example, thermal decomposition processes, electrochemical processes, physical processes such as atomization or milling and chemical reduction methods can be used. Thermal decomposition processes tend to produce powders that are spongy, agglomerated, and very porous whereas electrochemical processes produce powders that are crystalline in shape and very large. Physical processes are generally used to make flaked materials or very large spherical particles. Chemical precipitation processes produce silver powders with a range of sizes and shapes.

Silver powders used in electronic applications are generally manufactured using chemical precipitation processes. Silver powder is produced by chemical reduction in which an aqueous solution of a soluble salt of silver is reacted with an appropriate reducing agent under conditions such that silver powder can be precipitated. Inorganic reducing agents including hydrazine, sulfite salts and formate salts can produce powders which are very coarse in size, are irregularly shaped and have a large particle size distribution due to aggregation.

Organic reducing agents such as alcohols, sugars or aldehydes are used with alkali hydroxides to reduce silver nitrate. The reduction reaction is very fast; hard to control and produces a powder contaminated with residual alkali ions. Although small in size (<1 micron), these powders tend to have an irregular shape with a wide distribution of particle sizes that do not pack well. These types of silver powders exhibit difficult to control sintering and inadequate line resolution in thick film conductor circuits.

Therefore, the present inventors desired to create an improved method of formation of spherical silver particles, which are highly dispersible, which are very high solids, and highly ordered. The method of the present invention provides such an improvement.

Hungarian patent (1988) 194758 Nemeth et al. describes a process for producing silver powder in the presence of gum arabic.

German Patent (1988) DD(11)259,000 Penzvero et al. describes a procedure for the production of silver powder by the reduction of silver nitrate in the presence of a colloid and complex-forming materials. Use colloid and gum arabic with ascorbic acid.

SUMMARY OF THE INVENTION

This invention is directed to a method for the formation of highly dispersible, spherical silver powder particles that are very high solids and highly ordered comprising the sequential steps of:

- preparing an aqueous nitric acid solution of a silver salt wherein said aqueous nitric acid solution comprises a silver salt;
- preparing a reducing solution comprising: (i) a reducing agent ascorbic acid; (ii) one or more surface modifier(s); and (iii) a particle size modifier; and
- mixing together the aqueous nitric acid solution of silver salt and said reducing solution to form silver powder particles in a final aqueous solution wherein said final aqueous solution has a pH of less than or equal to 6.

The invention also relates to the above method, further comprising the steps of:

- separating said silver powder particles from said final aqueous solution;
- providing deionized water;
- washing the silver powder particles with said deionized water; and
- drying said silver powder particles.

DETAILED DESCRIPTION OF THE INVENTION

The process of the invention is a reductive process in which very high solids, highly ordered, finely divided, and controlled morphology silver particles are precipitated by adding together an aqueous acid solution of a silver salt and an aqueous acid solution containing the mixture of ascorbic acid, nitric acid, a surface modifier, and a particle size modifier. Particles with very high solids have a solids content greater than or equal to 99.7 weight percent. Solids are measured by the weight loss method after heating at 850° C. for 10 minutes. Highly ordered is defined herein as <0.3 microns full width at half the maximum for the silver peak as measured by x-ray diffraction. Finely divided is defined herein as non-agglomerated with a $d_{50}$ divided by the average particle size from the scanning electron microscope (measured at 6000×) being 1.0-1.6. Controlled morphology as determined by scanning electron microscopy, can be controlled between making spherical shaped particles, faceted, two-dimensional flake shape, and mixtures of spherical particles and two-dimensional flakes.

The aqueous acid solution of a silver salt is prepared by adding a water-soluble silver salt to deionized water to form the aqueous acid silver mixture. Nitric acid is added to make the aqueous acid silver mixture acidic which makes the particles highly ordered. Without additional surface modifiers, the particles are polyhedrons with faceted morphology. Any water-soluble silver salt can be used in the process of the invention such as silver nitrate, silver phosphate, and silver sulfate. An advantage of using an aqueous acid solution of a silver salt is that no insoluble silver salts are precipitated which would be precipitated in a basic solution. In addition, no complexing agents are used which could provide side reactions that affect the reduction and type of particles produced.

The reducing and particle modifier solution is prepared by first dissolving the reducing agent in deionized water. Suitable reducing agents for the process for the invention are L-ascorbic acid, D-ascorbic acid, their salts and related compounds such as sodium ascorbate, D-isoascorbic acid, etc.

The surface and particle size modifiers are then added to the mixture. The surface modifiers are added to control the morphology of the individual particles and to produce finely divided particles. Suitable surface modifiers for controlling the morphology of the particles for the process for the invention are potassium sulfate, sodium sulfate, potassium phosphate, sodium phosphate, potassium carbonate, and sodium carbonate. Potassium sulfate is the preferred modifier for controlling morphology. The amount of the modifier needed for the spherical morphology ranges from $10^{-5}$ moles per gram of silver to $10^{-2}$ moles per gram of silver and the preferred range is from $6\times10^{-5}$ moles per gram of silver to $9\times10^{-3}$ moles per gram of silver. Silver particles that are polyhedrons with faceted morphology are formed when there is insufficient amount of the surface modifier for controlling the morphology of the particles. Silver particles that are highly aggregated and sintered together are formed when too much of the surface modifier for controlling the morphology of the particles is used.

Suitable surface modifiers for making finely divided silver particles for the process for the invention are gum arabic, ammonium stearate and other stearate salts, salts of polynaphthalene sulfonate formaldehyde condensate such as Daxad 19, polyethylene glycol with molecular weight ranges from 200 to 8000, and mixtures of these surfactants. The amount of the surface modifier ranges from 0.001 g per gram of silver to greater than 0.2 grams per gram of silver. The preferred range to make finely divided particles is from 0.04 to 0.20 grams per gram of silver. Highly agglomerated silver particles with a larger than 1.6 value for the $d_{50}$ divided by the average particle size from the scanning electron microscope (measured at 6000×) are formed when too little surface modifier for controlling the dispersion is used.

Suitable particle size modifiers for the process for the invention are metal colloids such as gold colloid or silver colloid. Additional suitable particle size modifiers can be produced in situ by adding a small amount of another reducing agent such as sodium borohydride. Very large particles are formed when there is no colloid added to the process. As additional colloid is added to the process, the particles become smaller. Once the colloid is added to the reducing and particle modifier solution, the solution needs to be used within 5 hours to avoid a change in the targeted particle size.

The process is run such that the pH of the solution after the reduction is completed (final aqueous solution) is less than or equal to 6. However, in one embodiment it is preferred to run the process of the invention such that the solution after the reduction is completed has a pH of 2 or lower. This is adjusted by adding nitric acid to either the reducing and particle modifier solution or the aqueous acid silver mixture prior to the formation of the silver particles. Making the silver powder at a pH greater than 2 produces silver particles that are not highly ordered nor finely divided.

The process can be run at concentrations up to 0.45 moles of silver per liter of final solution after the reduction. It is preferred to run the process at concentrations less than or equal to 0.25 moles of silver per liter of final solution after the reduction.

The process can be run at temperatures from 10° C. to 35° C. The process can also be run at higher temperatures, e.g., from 36° C. to 44° C. and higher. At temperatures greater than 45° C., two-dimensional silver flakes are formed. As the temperature is increased, more silver flakes than the uniformly shaped particles are formed. At concentrations of greater than 0.45 moles of Ag per liter of final solution after the reduction, and temperatures greater than 70° C., the majority of particles formed are two-dimensional silver flakes.

The order of preparing the aqueous acid solution of a silver salt and the reducing and particle modifier solution is not important. The aqueous acid solution of a silver salt may be prepared before, after, or contemporaneously with the reducing and particle modifier solution. Either solution can be added to the other to form the very high solids, highly ordered, finely divided, and uniformly shaped silver particles. The two solutions are mixed quickly with a minimum of agitation to avoid agglomeration of the silver particles.

The water is then removed from the suspension by filtration or other suitable liquid-solid separation operation and the solids are washed with deionized water until the conductivity of the wash water is 100 microsiemans or less. The water is then removed from the silver particles and the particles are dried.

Thick Film Paste and Tape Applications

The silver particles formed by the method of the present invention are particularly useful in thick film paste and tape applications. In one embodiment, the silver particles are used in thick film pastes and tapes for use in flat panel display applications. In some embodiments, these pastes and tapes are photosensitive compositions.

General Paste Preparation

Thick film compositions comprise electrically functional materials (in this case, Ag formed by the method of the present invention) and organic components, which comprises organic binder(s) and solvent(s). Optionally, other components, such as inorganic binders, photoinitiators, and other additives, may be added to the thick film composition depending on the desired use.

Typically, thick film compositions are formulated to have a paste-like consistency, and are therefore, called "pastes". Generally, the pastes are prepared under yellow light by mixing the organic vehicle, monomer(s), and other organic components in a mixing vessel. The inorganic materials are then added to the mixture of organic components. The total composition is then mixed until the inorganic powders are wetted by the organic materials. The mixture is then typically roll milled using a three roll mill. The paste viscosity may then be adjusted with the appropriate vehicle or solvent to achieve a viscosity optimum for processing. Paste compositions may be photosensitive.

Flat Panel Display Applications

One use of the Ag formed by the method of the present invention is described herein in terms of one embodiment, in a plasma display panel (PDP) application. This description of the use of the Ag formed by the method of the present invention is not intended to be limiting. The Ag formed by the method of the present invention may be useful in a multitude of applications, including but not limited to, thick film paste applications, thick film tape applications, and flat panel display applications including PDP applications.

EXAMPLES

The following examples and discussion are offered to further illustrate, but not limit the process of this invention. A summary of the recipes for the examples is presented in Table 1 and a summary of the measured properties is presented in Table 2. Note that particle size distribution numbers ($d_{10}$, $d_{50}$, $d_{90}$) were measured using a Microtrac® machine from Leeds and Northrup, full width half maximum (FWHM) was measured using an x-ray diffractometer, and the SEM size was measured by taking an average from the scanning electron microscope (SEM) picture taken at 6000× magnification.

Example 1

The silver nitrate solution was prepared by dissolving 80 g of silver nitrate in 2000 g of deionized water and kept at room temperature while stirring.

The reducing solution was prepared by adding and dissolving 40 g of ascorbic acid to 2000 g of deionized water in a separate container from the silver nitrate solution. This solution was continuously stirred and the temperature controlled to room temperature. 40 g of nitric acid was then added to the reducing solution followed by the addition of 3 g of potassium sulfate. In a separate container, 1 g of gum arabic is dissolved in 50 g of deionized water. After dissolution is complete, the gum arabic solution is added to the reducing solution. As a final step, 5 g of a gold colloid solution is added to the reducing solution.

After the reducing solution is ready, it was added to the silver nitrate solution without any additional agitation in less than 5 seconds. After three minutes, the reaction mixture was filtered and the silver powder collected. The silver powder was washed with deionized water until a conductivity of the wash water was less than or equal to 100 microsiemans. The finished silver powder was collected and dried for 30 hours at 30° C.

Examples 2-7

Examples 2 through 7 were made using the process described in Example 1 except that the amount of gold colloid was varied between 0 g and 50 g. As the amount of gold colloid is increased, the particles decrease in size. This is shown by the resultant particle size as shown by SEM.

Examples 8-14

Examples 8 through 14 were made using the process described in Example 1 except that the amount of gum arabic was varied from 0 grams to 2 gram. Example 8, that has no gum arabic, was found to be very large and agglomerated. As the amount of gum arabic is increased, the particle size distribution is decreased. The particle size distribution was no longer improved with more than 2 grams.

Examples 15-24

Examples 15-24 were made using the process described in Example 1 except that the amount of potassium sulfate is varied between 0 and 5 g. Using less than 1 g produced polyhedron shaped particles. Using more than 3 grams gives agglomerated powder.

Examples 25-28

Examples 25 through 28 were made using the process described in Example 1 except the temperature of the silver nitrate solution and the reducing solution was varied between 23° C. and 75° C. As shown in examples 27 and 28, operating the process above 45° C. produces more and more two-dimensional silver flake shaped particles.

Examples 29-30

Example 29 is the data on a spherical silver powder produced using a base reducing system with a pH of about 10. Example 30 is the data from a 7000 series spherical silver powder purchased from Ferro Electronic Materials Systems. These examples have larger FWHM in contrast to the examples of the invention.

TABLE 1

| Example | Temperature ° C. | Amount of DI water in Solution A grams | Amount of AgNO3 in Solution A grams | Amount of HNO3 in Solution A grams | Amount of DI water in Solution B grams | Amount of ascorbic acid in Solution B grams | Amount of HNO3 in Solution B grams | Amount of potassium sulfate in Solution B grams | Amount of gum arabic in Solution B grams | Amount of gold colloid in Solution B grams |
|---|---|---|---|---|---|---|---|---|---|---|
| 1 | 20 | 1000 | 80 | 0 | 1000 | 40 | 40 | 3 | 0.15 | 5 |
| 2 | 23 | 1000 | 80 | 0 | 1000 | 40 | 40 | 3 | 0.05 | 0 |
| 3 | 23 | 1000 | 80 | 0 | 1000 | 40 | 40 | 3 | 0.05 | 1 |
| 4 | 23 | 1000 | 80 | 0 | 1000 | 40 | 40 | 3 | 0.1 | 2 |
| 5 | 23 | 1000 | 80 | 0 | 1000 | 40 | 40 | 3 | 0.05 | 5 |
| 6 | 23 | 2000 | 80 | 0 | 2000 | 40 | 40 | 3 | 0.15 | 25 |
| 7 | 23 | 2000 | 80 | 0 | 2000 | 40 | 40 | 3 | 0.15 | 50 |
| 8 | 23 | 1000 | 80 | 0 | 1000 | 40 | 40 | 3 | 0 | 1 |
| 9 | 23 | 1000 | 80 | 0 | 1000 | 40 | 40 | 3 | 0.25 | 1 |
| 10 | 23 | 2000 | 80 | 0 | 2000 | 40 | 40 | 3 | 0.15 | 5 |
| 11 | 23 | 2000 | 80 | 0 | 2000 | 40 | 40 | 3 | 0.5 | 5 |
| 12 | 23 | 2000 | 80 | 0 | 2000 | 40 | 40 | 3 | 1 | 5 |
| 13 | 23 | 2000 | 80 | 0 | 2000 | 40 | 40 | 3 | 1.5 | 5 |
| 14 | 23 | 2000 | 80 | 0 | 2000 | 40 | 40 | 3 | 2 | 5 |
| 15 | 23 | 1000 | 80 | 0 | 1000 | 40 | 40 | 0 | 0.05 | 1 |
| 16 | 23 | 1000 | 80 | 0 | 1000 | 40 | 40 | 0 | 0.05 | 1 |
| 17 | 23 | 2000 | 80 | 0 | 2000 | 40 | 40 | 0 | 0.15 | 1 |
| 18 | 23 | 2000 | 80 | 0 | 2000 | 40 | 40 | 0 | 0.15 | 5 |

TABLE 1-continued

| Example | Temperature ° C. | Amount of DI water in Solution A grams | Amount of AgNO3 in Solution A grams | Amount of HNO3 in Solution A grams | Amount of DI water in Solution B grams | Amount of ascorbic acid in Solution B grams | Amount of HNO3 in Solution B grams | Amount of potassium sulfate in Solution B grams | Amount of gum arabic in Solution B grams | Amount of gold colloid in Solution B grams |
|---|---|---|---|---|---|---|---|---|---|---|
| 19 | 23 | 1000 | 80 | 0 | 1000 | 40 | 40 | 1 | 0.15 | 5 |
| 20 | 23 | 1000 | 80 | 0 | 1000 | 40 | 40 | 3 | 0.05 | 5 |
| 21 | 23 | 2000 | 80 | 0 | 2000 | 40 | 40 | 3 | 0.15 | 1 |
| 22 | 23 | 2000 | 80 | 0 | 2000 | 40 | 40 | 3 | 0.15 | 5 |
| 23 | 23 | 1000 | 80 | 0 | 1000 | 40 | 40 | 5 | 0.05 | 5 |
| 24 | 23 | 1000 | 80 | 0 | 1000 | 40 | 40 | 10 | 0.05 | 5 |
| 25 | 23 | 2000 | 80 | 40 | 2000 | 40 | 0 | 3 | 0.15 | 5 |
| 26 | 45 | 2000 | 80 | 40 | 2000 | 40 | 0 | 3 | 0.15 | 5 |
| 27 | 65 | 2000 | 80 | 40 | 2000 | 40 | 0 | 3 | 0.15 | 5 |
| 28 | 75 | 2000 | 80 | 40 | 2000 | 40 | 0 | 3 | 0.15 | 5 |

TABLE 2

| Example | $D_{10}$ microns | $D_{50}$ microns | $D_{90}$ microns | SEM size microns | $D_{50}$/SEM size | Morphology by SEM | FWHM degree | Solids % |
|---|---|---|---|---|---|---|---|---|
| 1 | 0.91 | 2.12 | 3.69 | 1.1 | 1.93 | spherical | na | 99.8 |
| 2 | 4.32 | 8.12 | 13.55 | 5.0 | 1.62 | spherical | na | 99.96 |
| 3 | 1.44 | 3.27 | 5.83 | 1.9 | 1.72 | spherical | na | 99.91 |
| 4 | 1.12 | 2.77 | 4.68 | 1.87 | 1.48 | spherical | na | 99.9 |
| 5 | 0.88 | 1.83 | 3.41 | 1.3 | 1.41 | spherical | na | 99.9 |
| 6 | 0.75 | 1.72 | 3.38 | 1.03 | 1.67 | spherical | na | 99.82 |
| 7 | 0.61 | 1.45 | 3.02 | 0.83 | 1.75 | spherical | na | 99.76 |
| 8 | 4.42 | 10.99 | 29.0 | 3.4 | 3.23 | spherical | na | 99.81 |
| 9 | 1.45 | 3.29 | 5.73 | 2.03 | 1.62 | spherical | na | 99.83 |
| 10 | 0.95 | 1.91 | 3.06 | 1.1 | 1.74 | spherical | na | 99.78 |
| 11 | 0.86 | 1.63 | 2.7 | 1.18 | 1.38 | spherical | na | 99.74 |
| 12 | 0.92 | 1.3 | 2.43 | 1.41 | 0.92 | spherical | na | 99.7 |
| 13 | 0.86 | 1.35 | 1.96 | 1.3 | 1.04 | spherical | na | 99.6 |
| 14 | 0.81 | 1.33 | 1.93 | 1.1 | 1.21 | spherical | na | 99.6 |
| 15 | 0.83 | 1.64 | 3.23 | 1.9 | 0.86 | faceted | 0.207 | 99.86 |
| 16 | 1.04 | 1.64 | 2.84 | 1.90 | 0.86 | faceted | 0.207 | 99.86 |
| 17 | 1.15 | 1.76 | 2.78 | 1.60 | 1.10 | faceted | 0.216 | 99.63 |
| 18 | 0.72 | 1.09 | 1.57 | 1.00 | 1.09 | faceted | 0.204 | 99.68 |
| 19 | 0.88 | 1.83 | 3.41 | 1.24 | 1.48 | spherical | na | 99.81 |
| 20 | 0.95 | 1.91 | 3.06 | 1.3 | 1.47 | spherical | na | 99.9 |
| 21 | 1.11 | 2.85 | 4.82 | 1.60 | 1.78 | spherical | 0.221 | 99.83 |
| 22 | 1.13 | 2.60 | 4.61 | 1.23 | 2.11 | spherical | 0.212 | 99.65 |
| 23 | na | na | na | na | na | amorphous | na | na |
| 24 | na | na | na | na | na | amorphous | na | na |
| 25 | 1.12 | 2.64 | 5.5 | 1.3 | 2.03 | spherical | na | 99.68 |
| 26 | 1.37 | 3.47 | 6.49 | bimodal | na | spherical/flakes | na | 99.64 |
| 27 | 2.35 | 5.71 | 10.3 | bimodal | na | spherical/flakes | na | 99.46 |
| 28 | 2.69 | 5.58 | 9.8 | bimodal | na | spherical/flakes | na | 99.59 |
| 29 | 2.1 | 3.2 | 4.8 | 2.80 | 1.14 | spherical | 0.389 | 98.70 |
| 30 | 1.30 | 2.61 | 5.0 | na | na | spherical | 0.253 | 99.82 |

What is claimed is:

1. A method for the formation of very high solids, highly ordered, finely divided, and controlled morphology silver powder particles comprising the sequential steps of:

(a) preparing an aqueous solution of a silver salt wherein said aqueous solution comprises a silver salt dissolved in de-ionized water;

(b) preparing a reducing solution comprising:

(i) de-ionized water;

(ii) nitric acid;

(iii) a reducing agent consisting of ascorbic acid;

(iv) a particle surface morphology modifier chosen from the group consisting of potassium sulfate, sodium sulfate, potassium phosphate, sodium phosphate, potassium carbonate and sodium carbonate;

(v) a surface modifier chosen from the group consisting of gum arabic, ammonium stearate, stearate salts, salts of polynaphthalene sulfonate formaldehyde condensate, polyetheylene glycol with molecular weight 2100 to 8000, and mixtures of these surfactants;

(vi) a particle modifier chosen from the group consisting of gold colloid, silver colloid and sodium borohydride; and (c) mixing together the aqueous solution of silver salt and said reducing solution to form silver powder particles in a final aqueous solution wherein said final aqueous solution has a pH of less than or equal to 6.

2. The method of claim 1 further comprising the steps of:

d) separating said silver powder particles from said final aqueous solution;

e) providing deionized water;

f) washing the silver powder particles with said deionized water; and g) drying said silver powder particles.

3. The method of claim 1 wherein said silver salt is silver nitrate.

4. The method of claim 1 wherein step (c) is performed at a temperature in the range of 10° C. to 35° C.

5. The method of claim 1 wherein step (c) is performed at a temperature in the range of 36° C. to 44° C.

6. The method of claim 1 wherein step (c) is performed at a temperature of greater than 45° C. and the silver powder particles are predominantly two dimensional flakes.

7. The method of claim 1 wherein said particle surface morphology modifier is potassium sulfate.

8. The method of claim 1 wherein said particle size modifier is a metal colloid.

9. The method of claim 1 wherein said surface modifier for making finely divided silver particles is gum arabic.

10. The method of claim 1 wherein the pH of said final aqueous solution is less than or equal to 2.

11. The use of the silver powder particles formed by the method of claim 1, as electrically functional materials in a paste in thick film applications comprising:

forming a thick film consisting of electrically functional materials, inorganic binders, and solvents;

coating said paste on a substrate; and firing said coated substrate to form a conductive circuit.

12. A method for the formation of very high solids, highly ordered, finely divided, and controlled morphology silver powder particles comprising the sequential steps of:

(a) preparing an aqueous nitric acid solution of a silver salt wherein said aqueous nitric acid solution comprises a silver salt;

(b) preparing a reducing solution comprising:

(i) de-ionized water;

(i) a reducing agent consisting of ascorbic acid;

(iii) a particle surface morphology modifier chosen from the group consisting of potassium sulfate, sodium sulfate, potassium phosphate, sodium phosphate, potassium carbonate and sodium carbonate;

(iv) a surface modifier chosen from the group consisting of gum arabic, ammonium stearate, stearate salts, salts of polynaphthalene sulfonate formaldehyde condensate, polyetheylene glycol with molecular weight 2100 to 8000, and mixtures of these surfactants;

(v) a particle modifier chosen from the group consisting of gold colloid, silver colloid and sodium borohydride; and (c) mixing together the aqueous nitric acid solution of silver salt and said reducing solution to form silver powder particles in a final aqueous solution wherein said final aqueous solution has a pH of less than or equal to 6.

* * * * *

UNITED STATES PATENT AND TRADEMARK OFFICE

CERTIFICATE OF CORRECTION

PATENT NO. : 7,648,557 B2
APPLICATION NO. : 11/809486
DATED : January 19, 2010
INVENTOR(S) : Roberto Irizarry-Rivera, Victor M. Rivera Alvarado and Howard David Glicksman It is certified that error appears in the above-identified patent and that said Letters Patent is hereby corrected as shown below:

Column 10, Line 9: "(i)" should read --(ii)--

Signed and Sealed this

Thirtieth Day of March, 2010

David J. Kappos

David J. Kappos
*Director of the United States Patent and Trademark Office*